US009015870B2

(12) United States Patent
Ball

(10) Patent No.: US 9,015,870 B2
(45) **Date of Patent: *Apr. 28, 2015**

(54) MEANS FOR COVERING THE FLANGE OF A WASTE WATER STRAINER

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 813 days.

This patent is subject to a terminal disclaimer.

(21) Appl. No.: 13/041,929

(22) Filed: Mar. 7, 2011

(65) Prior Publication Data

US 2011/0209279 A1 Sep. 1, 2011

Related U.S. Application Data

(63) Continuation-in-part of application No. 12/405,956, filed on Mar. 17, 2009, now abandoned, which is a continuation of application No. 11/161,933, filed on Aug. 23, 2005, now Pat. No. 7,503,083.

(51) Int. Cl.
*E03C 1/26* (2006.01)
*E03C 1/22* (2006.01)

(52) U.S. Cl.
CPC ..... *E03C 1/22* (2013.01)

(58) Field of Classification Search
CPC ..... E03C 1/264; E03C 1/262
USPC ..... 4/292, 286, 288, 388, 384, 393, 381
See application file for complete search history.

(56) References Cited

U.S. PATENT DOCUMENTS

| | | | |
|---|---|---|---|
| 569,247 | A | 10/1896 | Smith |
| 820,437 | A | 5/1906 | Pehrson |
| 1,805,816 | A | 5/1931 | Fleming |
| 2,190,532 | A | 2/1940 | Lukomski |
| 2,222,807 | A | 11/1940 | Burr |
| 2,278,566 | A | 4/1942 | Schaible |
| 2,323,224 | A | 6/1943 | Kuhnle |
| 2,528,919 | A | 11/1950 | Stone et al. |
| 2,736,577 | A | 2/1956 | Mackey |

(Continued)

FOREIGN PATENT DOCUMENTS

| | | |
|---|---|---|
| CA | 530215 | 9/1956 |
| DE | 419477 | 9/1925 |

(Continued)

OTHER PUBLICATIONS

Notice of Allowance for U.S. Appl. No. 13/669,417 mailed Sep. 27, 2013, 9 pages.

(Continued)

*Primary Examiner* — Lauren Crane
(74) *Attorney, Agent, or Firm* — Sheridan Ross P.C.

(57) ABSTRACT

A waste water insert has a wall surrounding a vertical bore. A horizontal flange extends outwardly from the upper end of the wall and has a lip formed on its outer periphery. The horizontal flange of the waste water insert is super-imposed over the horizontal flange of a waste water strainer located in a bathtub, sink or the like. The wall of the insert extends downwardly through the cylindrical wall of the waste water strainer with the two walls being spaced from each other by virtue of the cylindrical wall of the insert having a smaller diameter than that of the strainer.

10 Claims, 12 Drawing Sheets

(56) References Cited

U.S. PATENT DOCUMENTS

| | | | | |
|---|---|---|---|---|
| 2,890,463 | A | 6/1959 | Young | |
| 2,905,951 | A | 9/1959 | Weddendorf, Jr. | |
| 2,976,543 | A | 3/1961 | Turner et al. | |
| 3,037,212 | A | 6/1962 | Kleinhof | |
| 3,046,028 | A | 7/1962 | Nathan | |
| 3,048,415 | A | 8/1962 | Shook | |
| 3,096,527 | A | 7/1963 | Eynon | |
| 3,311,391 | A | 3/1967 | Harrell | |
| 3,316,562 | A | 5/1967 | Van Dyke et al. | |
| 3,345,085 | A | 10/1967 | Hanes | |
| 3,349,412 | A | 10/1967 | Schwartz et al. | |
| 3,380,081 | A | 4/1968 | Eilerstson et al. | |
| 3,501,172 | A | 3/1970 | Pickard | |
| 3,579,670 | A | 5/1971 | Frank | |
| 3,615,984 | A | 10/1971 | Chase | |
| 3,684,199 | A | 8/1972 | Bebinger | |
| 3,800,339 | A | 4/1974 | Bergin | |
| 3,813,708 | A | 6/1974 | Hamburg | |
| 3,881,201 | A | 5/1975 | Richards | |
| 3,911,635 | A | 10/1975 | Traupe | |
| 3,982,289 | A | 9/1976 | Robbins | |
| 4,059,289 | A | 11/1977 | Morris et al. | |
| 4,207,632 | A | 6/1980 | Savell, Jr. et al. | |
| 4,232,407 | A | 11/1980 | Williams | |
| 4,257,892 | A | 3/1981 | Boersma | |
| 4,310,933 | A | 1/1982 | Stratman | |
| 4,320,540 | A | 3/1982 | Leavens | |
| 4,329,744 | A | 5/1982 | Cuschera | |
| 4,359,788 | A | 11/1982 | Liou | |
| 4,412,361 | A | 11/1983 | Cuschera | |
| 4,502,166 | A | 3/1985 | Brown, Sr. | |
| 4,505,499 | A | 3/1985 | Uglow et al. | |
| 4,571,751 | A | 2/1986 | Barlow | |
| 4,574,402 | A | 3/1986 | Brown, Sr. | |
| 4,594,740 | A | 6/1986 | Tseronakis | |
| 4,692,948 | A | 9/1987 | Martin | |
| 4,706,306 | A | 11/1987 | Smith | |
| 4,720,877 | A | 1/1988 | Watts | |
| 4,799,713 | A | 1/1989 | Uglow | |
| 4,850,617 | A * | 7/1989 | Moberly | 285/42 |
| 5,165,118 | A | 11/1992 | Cendrowski | |
| 5,265,281 | A * | 11/1993 | McAlpine | 4/287 |
| 5,271,108 | A | 12/1993 | Wicke | |
| 5,291,619 | A | 3/1994 | Adorjan | |
| 5,297,817 | A | 3/1994 | Hodges | |
| 5,318,230 | A | 6/1994 | Ferguson et al. | |
| 5,330,811 | A | 7/1994 | Buchalter | |
| 5,369,815 | A | 12/1994 | Martin | |
| 5,372,715 | A | 12/1994 | Maggard et al. | |
| 5,376,264 | A | 12/1994 | Betancourt | |
| 5,418,983 | A | 5/1995 | Garguillo et al. | |
| 5,442,819 | A | 8/1995 | Penor et al. | |
| 5,535,455 | A | 7/1996 | Liu | |
| 5,560,052 | A | 10/1996 | Ferguson et al. | |
| 5,692,248 | A | 12/1997 | Ball | |
| 5,745,931 | A * | 5/1998 | Ball | 4/286 |
| 5,758,368 | A | 6/1998 | Ball | |
| 5,819,328 | A | 10/1998 | Lewis | |
| 5,881,397 | A | 3/1999 | Hobbs | |
| 5,890,241 | A | 4/1999 | Ball | |
| 5,924,635 | A | 7/1999 | Koshimizu et al. | |
| 5,937,450 | A | 8/1999 | Jones | |
| 6,058,526 | A | 5/2000 | Parisi et al. | |
| 6,066,119 | A | 5/2000 | Ball | |
| 6,067,669 | A | 5/2000 | Peterson et al. | |
| 6,070,910 | A | 6/2000 | Hodges | |
| 6,085,362 | A | 7/2000 | Huber | |
| 6,088,843 | A | 7/2000 | Francisco | |
| 6,108,828 | A | 8/2000 | Cheng | |
| 6,138,290 | A | 10/2000 | Lin | |
| 6,148,454 | A | 11/2000 | Ball | |
| 6,154,898 | A | 12/2000 | Ball | |
| 6,173,459 | B1 | 1/2001 | Ball | |
| 6,195,819 | B1 | 3/2001 | Wang | |
| 6,226,806 | B1 | 5/2001 | Ball | |
| 6,269,495 | B1 | 8/2001 | Sondrup | |
| 6,317,906 | B1 | 11/2001 | Ball | |
| 6,332,632 | B1 | 12/2001 | Hodges | |
| 6,418,570 | B1 | 7/2002 | Ball | |
| 6,490,739 | B1 | 12/2002 | Lee | |
| 6,631,623 | B1 | 10/2003 | Ball | |
| 6,637,050 | B1 | 10/2003 | Ball | |
| 6,640,358 | B2 | 11/2003 | Ball | |
| 6,675,406 | B2 | 1/2004 | Ball | |
| 6,675,407 | B1 | 1/2004 | Ball | |
| 6,681,420 | B1 | 1/2004 | Ball | |
| 6,691,411 | B2 | 2/2004 | Ball | |
| 6,719,294 | B2 | 4/2004 | Nguyen et al. | |
| 6,735,791 | B1 | 5/2004 | Lordahl et al. | |
| 6,789,275 | B2 | 9/2004 | Spells, Sr. et al. | |
| 6,795,987 | B2 | 9/2004 | Cornwall | |
| 6,799,606 | B1 | 10/2004 | Howson | |
| 6,800,024 | B1 | 10/2004 | Prevost | |
| 6,880,179 | B2 * | 4/2005 | Wang | 4/295 |
| 6,895,838 | B2 | 5/2005 | Stahnke | |
| 7,013,500 | B1 | 3/2006 | Lin | |
| 7,055,184 | B2 | 6/2006 | Humber | |
| 7,127,752 | B2 | 10/2006 | Ball | |
| 7,188,376 | B2 | 3/2007 | Ortiz et al. | |
| 7,451,502 | B2 | 11/2008 | Ball | |
| 7,503,083 | B2 | 3/2009 | Ball | |
| 7,740,197 | B1 | 6/2010 | Schulz | |
| 7,814,580 | B2 | 10/2010 | Coronado et al. | |
| 8,347,906 | B1 | 1/2013 | Ismert et al. | |
| 8,925,123 | B2 | 1/2015 | Degooyer et al. | |
| 2002/0023294 | A1 | 2/2002 | Spells, Sr. | |
| 2003/0025275 | A1 | 2/2003 | Miller | |
| 2003/0182721 | A1 | 10/2003 | Li | |
| 2004/0117907 | A1 | 6/2004 | Ball | |
| 2004/0163165 | A1 | 8/2004 | Ortiz et al. | |
| 2005/0035558 | A1 | 2/2005 | Dipzinski et al. | |
| 2005/0050623 | A1 | 3/2005 | Greene | |
| 2005/0108814 | A1 | 5/2005 | Thompson | |
| 2006/0170208 | A1 | 8/2006 | Arning et al. | |
| 2006/0283792 | A1 | 12/2006 | McCallum | |
| 2007/0039098 | A1 | 2/2007 | Ball | |
| 2008/0047060 | A1 | 2/2008 | Ball | |
| 2008/0098504 | A1 | 5/2008 | Knox et al. | |
| 2008/0098517 | A1 | 5/2008 | Ball | |
| 2008/0148469 | A1 | 6/2008 | Dipzinski et al. | |
| 2008/0196161 | A1 | 8/2008 | Ball | |
| 2009/0119826 | A1 | 5/2009 | Coronado | |
| 2009/0172877 | A1 | 7/2009 | Ball | |
| 2010/0037392 | A1 | 2/2010 | Ball et al. | |
| 2011/0035867 | A1 | 2/2011 | Coronado et al. | |
| 2011/0173747 | A1 | 7/2011 | Evans et al. | |
| 2011/0289667 | A1 | 12/2011 | Oropallo et al. | |
| 2012/0048070 | A1 | 3/2012 | Richter | |
| 2012/0090084 | A1 | 4/2012 | Ball | |
| 2013/0055494 | A1 | 3/2013 | Ball | |
| 2013/0067648 | A1 | 3/2013 | Whitehead | |
| 2013/0193042 | A1 | 8/2013 | Hull | |
| 2013/0269100 | A1 | 10/2013 | Ball et al. | |
| 2014/0101834 | A1 | 4/2014 | Ball | |
| 2014/0138297 | A1 | 5/2014 | Hull | |

FOREIGN PATENT DOCUMENTS

| | | |
|---|---|---|
| DE | 1784266 | 10/1971 |
| DE | 3621715 | 1/1988 |
| DE | 9200488 | 3/1992 |
| DE | 4206903 | 9/1993 |
| DE | 20118252 | 3/2003 |
| GB | 1216285 | 12/1970 |
| JP | S53-58752 | 5/1978 |
| JP | H05-15887 | 3/1993 |
| JP | H05-88393 | 12/1993 |
| JP | H09-108130 | 4/1997 |
| JP | 2000-513421 | 10/2000 |
| JP | 2003-313913 | 11/2003 |
| WO | WO 99/54560 | 10/1999 |
| WO | WO 02/063109 | 8/2002 |

(56) References Cited

FOREIGN PATENT DOCUMENTS

| | | |
|---|---|---|
| WO | WO 2004/074587 | 9/2004 |
| WO | WO 2009/063334 | 5/2009 |
| WO | WO 2013/112560 | 8/2013 |

OTHER PUBLICATIONS

Complaint for Delaratory Relief (with Exhibits 1-7), *IPS Corporation* v. *WCM Industries, Inc.*, United States District Court for the Western District of Tennessee, Case No. 2:12-cv-02694, filed Aug. 9, 2012, 58 pages.
Defendant WCM Industries, Inc's Answer to Complaint, Affirmative Defenses and Counterclaims Against IPS Corporation, *IPS Corporation* v. *WCM Industries, Inc.*, United States District Court for the Western District of Tennessee, Case No. 2:12-cv-02694-JPM-tmp, filed Apr. 12, 2013, 10 pages.
Plaintiff IPS Corporation's Answer to Defendant WCM Industries, Inc's Counterclaims, *IPS Corporation* v. *WCM Industries, Inc.*; , United States District Court for the Western District of Tennessee, Case No. 2:12-cv-02694-JPM-tmp, filed May 3, 2013, 5 pages.
IPS Corporation's Initial Non-Infringement Contentions (with Exhibit A), *IPS Corporation* v. *WCM Industries, Inc.*, United States District Court for the Western District of Tennessee, Case No. 2:12-cv-02694-JPM-dkv, dated Jun. 7, 2013, 5 pages.
Plaintiff IPS's Initial Invalidity Contentions (with Exhibits A and B), *IPS Corporation* v. *WCM Industries, Inc.*, United States District Court for the Western District of Tennessee, Case No. 2:12-cv-02694-JPM-dkv, dated Aug. 6, 2013, 78 pages.
Official Action for U.S. Appl. No. 13/669,417 mailed Mar. 1, 2013, 7 pages.
"OATEYSCS Supply Chain Services Catalog," Oatey Co., 2012, 334 pages.
"Push N' Repair Closet Flange," IPS Corporation, 2011, [retrieved Sep. 6, 2014], 1 page. Retrieved from: http://web.archive.org/web/20111013024522/http://ipscorp.com/watertite/closetflanges/pushnrepair.
Official Action for U.S. Appl. No. 14/109,503 mailed Aug. 18, 2014, 6 pages.
Final Action for U.S. Appl. No. 14/109,503, mailed Dec. 29, 2014, 10 pages.
Official Action for U.S. Appl. No. 13/274,804 mailed Dec. 24, 2013, 10 pages.
Notice of Allowance for U.S. Appl. No. 13/274,804 mailed Apr. 23, 2014, 6 pages.
Examination and Search Report for United Kingdom Patent Application No. GB1118043.7, dated Oct. 31, 2011 6 pages.
Examiner's Report for Canadian Application No. 2,556,523, dated Feb. 16, 2009.
Notice of Allowance for U.S. Appl. No. 11/161,933, mailed Jan. 29, 2009.
Official Action for U.S. Appl. No. 11/161,933, mailed Jun. 23, 2008.
Official Action for U.S. Appl. No. 12/405,956, mailed Oct. 14, 2010.
"Press-In" Trim Kit, AB&A™ IPS Corporation (date unknown) 2 pages.
Official Action (with partial English summary) for Mexican Patent Application No. MX/a/2012/002782 dated Dec. 1, 2014, 3 pages.

* cited by examiner

MEANS FOR COVERING THE FLANGE OF A WASTE WATER STRAINER

This application is a Continuation-In-Part of U.S. patent application Ser. No. 12/405,956, filed Mar. 17, 2009, which is a Continuation of U.S. patent application Ser. No. 11/161,933, filed Aug. 23, 2005, now issued U.S. Pat. No. 7,503,083, the entire disclosures of which are incorporated by reference herein.

BACKGROUND OF THE INVENTION

A strainer in the plumbing field is the mechanism in the bottom of a sink, bathtub, or the like through which waste water flows from the receptacle. Strainers usually have valves or the like which control the flow of water therethrough. Most of these valve assemblies are threadably mounted within a threaded aperture located in the strainer.

Existing strainers have a vertically disposed externally threaded sleeve which engage corresponding threads on a fitting adjacent a vertically disposed aperture in the bottom of the water receptacle. The upper end of the sleeve terminates in a circular horizontal flange which engages and is sealed to the bottom of the receptacle around the aperture in the bottom of the receptacle. A hub with a threaded bore and with radially extending spokes is often located in a horizontal plane in the bottom of the strainer to support various closure valves.

Occasionally it is necessary to change the strainer of a given receptacle because the flange thereof has become tarnished, disfigured, or because the flange is incompatible esthetically with the owner's sense of ornamentation. Removal of the strainer is often a difficult task, particularly when the strainer has been in place for a long time. Conventional tools are typically insufficient for use in removal of the strainer. Further, there is a possibility that the threads of the replacement strainer will not be compatible with the threads of the fitting or bushing associated with the aperture of the receptacle. In addition, when the strainer is removed there is nothing to retain the back drain system and it falls away.

Some attempts have been made to place a substitute flange over the existing flange by providing structure whereby the substitute flange can be threadably secured to threaded bores of the strainer which originally threadably received the valve assembly of the strainer. This approach to the installation of a substitute flange is not satisfactory because variations of thread sizes in the original strainers are often incompatible with the thread sizes of the substituted flange adapter.

It is therefore an aspect of this invention to provide a cover and method for covering the flange of an existing strainer without removing the existing strainer.

A further aspect of this invention is to provide a cover and method for covering the flange of an existing strainer which will permit easy installation, and which will be well within the ability of those not being skilled in the plumbing art.

These and other aspects will be apparent to those skilled in the art.

SUMMARY OF THE INVENTION

A waste water insert has a cylindrical wall surrounding a cylindrical bore. A flange extends outwardly from the upper end of the wall and has a lip formed on its outer periphery.

The flange of the waste water insert is superimposed over the flange of a waste water strainer located in a bathtub, sink or the like. The lip at the outer perimeter of the flange of the insert fits over the outer periphery of the horizontal flange of the waste water strainer to center the insert on the strainer. The cylindrical wall of the insert extends downwardly through the cylindrical wall of the waste water strainer with the two walls being spaced from each other by virtue of the cylindrical wall of the insert having a smaller diameter than that of the strainer. The cylindrical wall of the strainer extends below the cylindrical wall of the insert, and has a lower circular edge. One or more grooves are positioned within the cylindrical wall of the insert that receive one or more resilient ring members that engage the cylindrical wall of the strainer.

It is one aspect of the present invention to provide an insert with a wall that has a portion that engages the wall of the waste water strainer. More specifically, as described above, some embodiments of the present invention employ one or more grooves that receive one or more resilient ring members to engage the wall of the waste water strainer. One skilled in the art, however, will appreciate that there are multiple ways to engage the wall of the waste water strainer. For example, one embodiment of the present invention employs seals that do not require a groove. That is, enlarged seals, broken seals, shim seals, and angled seals are contemplated. In some embodiments, the wall of the strainer is comprised of two different materials, such as a steel or aluminum flange and interconnected plastic or rubber wall.

It is a similar aspect of the present invention to provide an insert having a wall that has one or more engaging lips. In operation, an outer edge of the lip engages the cylindrical wall of the waste water strainer to center the insert. A centering feature may not comprise a continuous ring, but may instead include discontinuous extensions that act in concert to center the device. The wall engaging portions, e.g. lip(s), may be located adjacent to the insert flange, the end of the insert's wall, between the flange and the end of the wall, or a combination thereof. Frictional contact between the engaging lip and the strainer wall helps maintain the position of the insert. In some embodiments of the present invention, the insert's wall is conical wherein the diameter at a lowermost portion of the insert is greater than that of the opening in the flange. It is contemplated that insertion of the insert's cylindrical body into the strainer would require some deflection of the insert wall. After insertion, the wall of the insert will deflect outwardly to firmly engage the strainer wall. One of skill in the art will appreciate that a plurality of walls or tabs may be provided as opposed to a continuous insert wall. In still other embodiments of the present invention, the wall of the insert is angled or conical such that the lowermost portion has the smallest diameter. Here, a ring may be inserted into the insert to splay the insert wall outwardly to engage the strainer wall.

Still other embodiments of the present invention employ an adhesive positioned between the insert flange and the flange of the waste water strainer or set screws to secure the insert in place.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
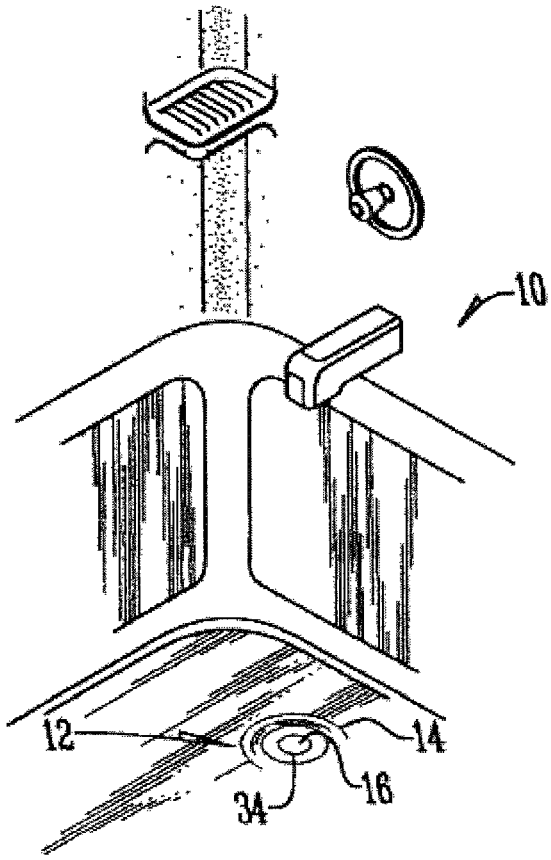
FIG. 1 is a partial perspective view of a bathtub with a waste water strainer located in the bottom thereof.

To assist in the understanding of one embodiment of the present invention, the following list of components and associated numbering found in the drawings is provided below:

| # | Component |
|---|---|
| 10 | Fluid compartment |
| 12 | Bottom |
| 14 | Bottom surface |
| 16 | Waste water aperture |
| 20 | Waste water strainer |
| 22 | Upper end |
| 24 | Flange |
| 26 | Outer perimeter |
| 28 | Cylindrical wall |
| 30 | Threads |
| 34 | Insert |
| 36 | Flange |
| 38 | Lip |
| 40 | Cylindrical wall |
| 42 | Center opening |
| 43 | Space |
| 44 | Groove |
| 46 | Resilient ring member |
| 50 | Raised surface |
| 52 | Resilient ring member |
| 54 | First portion |
| 58 | Second portion |
| 60 | Conical portion |
| 66 | Enlarged seal |
| 70 | Tapered surface |
| 74 | Button |
| 78 | Holes |
| 82 | Shims |
| 86 | Indentation |
| 90 | Angled seal |
| 94 | Lip |
| 98 | Conical wall |
| 102 | Inner lip |
| 106 | Ring |
| 110 | Adhesive |
| 114 | Set screw |
| 118 | Edge engagement member |
| 122 | Outer portion |
| 126 | Finger |
| 130 | Inner surface |
| 134 | Bottom edge |
| 138 | Extended outer portion |
| 142 | Inner portion |
| 146 | Outer portion |
| 150 | Groove |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

The numeral 10 designates a fluid compartment or receptacle such as a tub or a sink. Compartment 10 has a bottom 12 with an interior bottom surface 14. A waste water aperture 16 is located in bottom 12.

Figure 2:
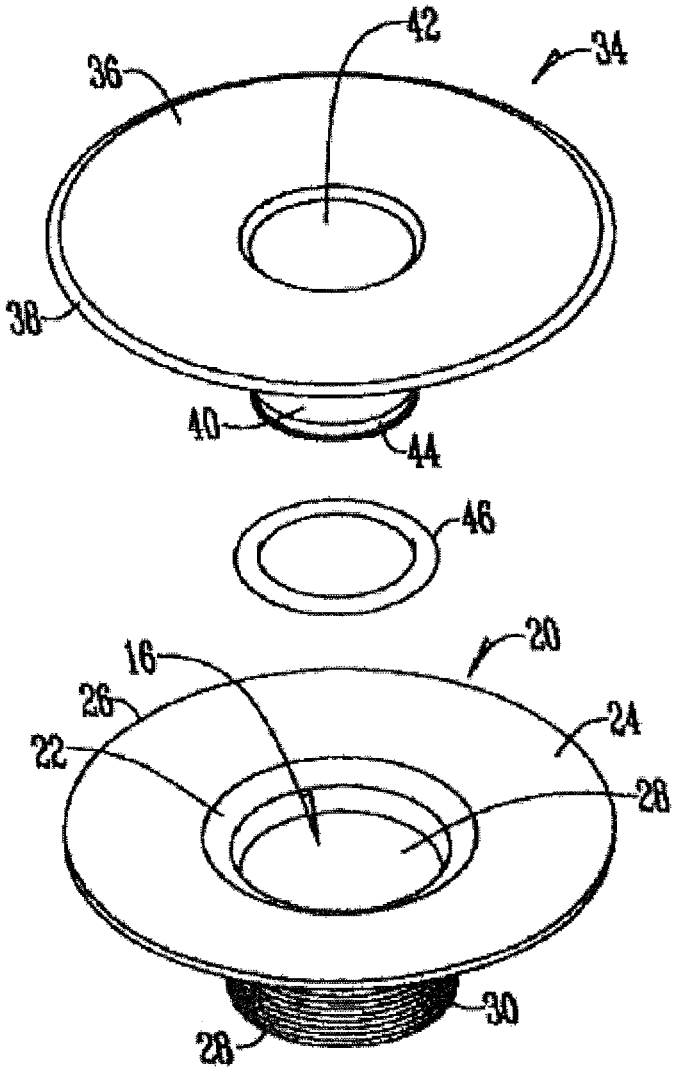
FIG. 2 is an exploded view showing a preliminary step in mounting the waste water insert onto the existing waste water strainer.

A waste water strainer 20 is shown in FIG. 2. Strainer 20 has an upper end 22 from which a circular flange 24 extends. The outer perimeter 26 of flange 24 engages the interior bottom surface 14 (FIG. 1) surrounding aperture 16. The strainer 20 has a downwardly extending cylindrical wall 28 and external threads 30. The typical closure valves which may be associated with strainer 20 have not been shown.

Figure 3:
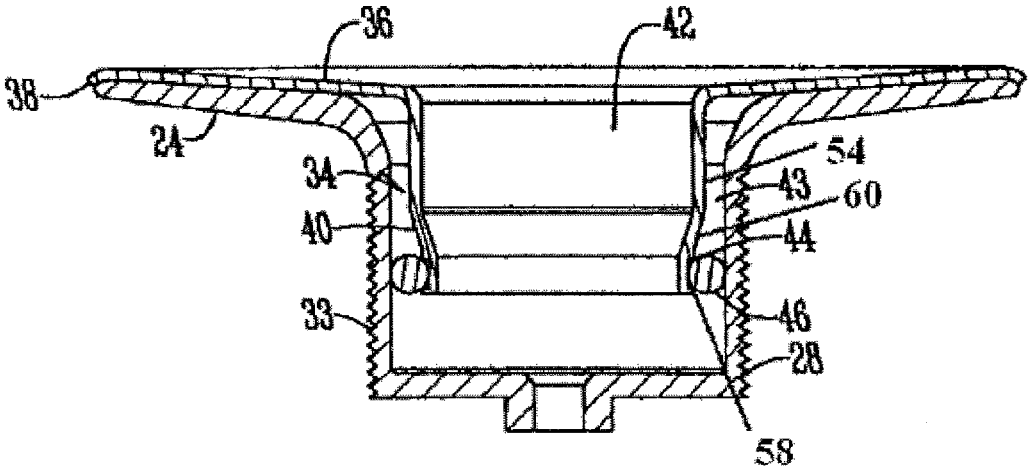
FIG. 3 is an unexploded cross sectional view of the assembly shown in FIG. 2.

The numeral 34 designates a waste water insert. Insert 34 has a flange 36 with the periphery thereof terminating in a downwardly extending lip 38. As best shown in FIG. 3, the lip 38 extends downwardly and over the outer perimeter 26 of flange 24 of strainer 20. The lip 38 engages the bottom 12 of compartment 10 when installed.

Insert 34 has a downwardly extending wall 40 which surrounds a center opening 42. The diameter of wall 40 is less than the diameter of the cylindrical wall 28 of strainer 20 so that a space 43 (FIGS. 3 and 4) exists between the two walls. The lip 38 on the outer perimeter of the flange 36 of insert 34 centers the cylindrical wall 40 within the cylindrical wall 28 of strainer 20 (FIG. 3). In one embodiment, the waste water insert 34 includes a wall 40 with a cylindrical first portion 54 and a cylindrical second portion 58 with a conical portion 60 therebetween. The diameter of the cylindrical first portion 54 is greater than the diameter of the cylindrical second portion 58 such that the space 43 is reduced adjacent to the cylindrical first portion 54.

The cylindrical wall 40 extends downwardly and has a first groove 44 in the lower end. The groove 44 receives a resilient ring member 46 that engages the cylindrical wall 28 of the strainer 20 to hold the insert 34 in place. In one embodiment, the resilient ring member 46 is an O-ring.

Figure 4:
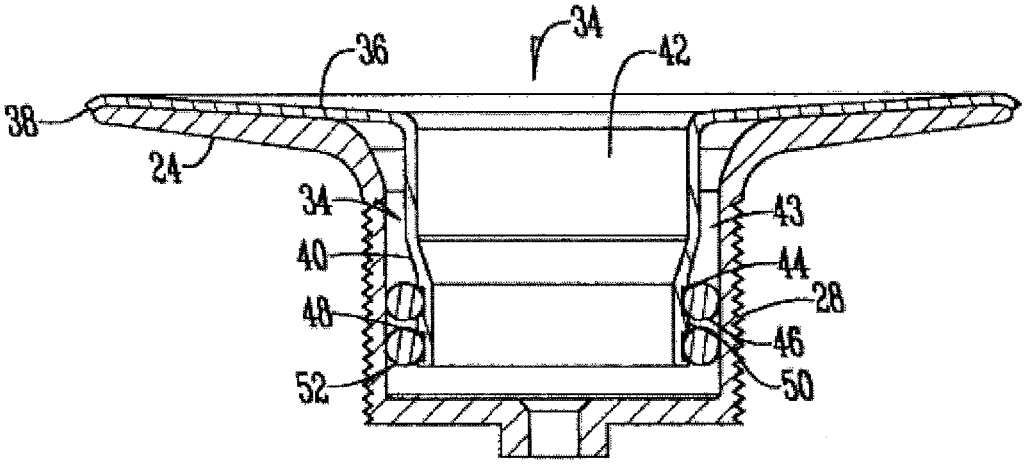
FIG. 4 is an unexploded cross sectional view similar to that of FIG. 3 showing a modified form of insert.

Alternatively, the waste water insert 34, as shown in FIG. 4, has a second groove 48 in spaced relation to the first groove 44 with a raised surface 50 therebetween. The second groove 48 receives a second resilient ring member 52 that also engages the cylindrical wall 28 of strainer 20. Additional grooves and rings may be added as desired.

The insert is installed by inserting the cylindrical wall 40 of the insert 34 into the opening 16 (FIG. 2) of the strainer 20 until the insert is in place. At this point the resilient ring or rings of the insert will engage the cylindrical wall 28 of the strainer 20 to hold the insert 34 in place. No tools are required and the inserts are quickly, easily, and securely installed to achieve their required purpose.

Figure 5:
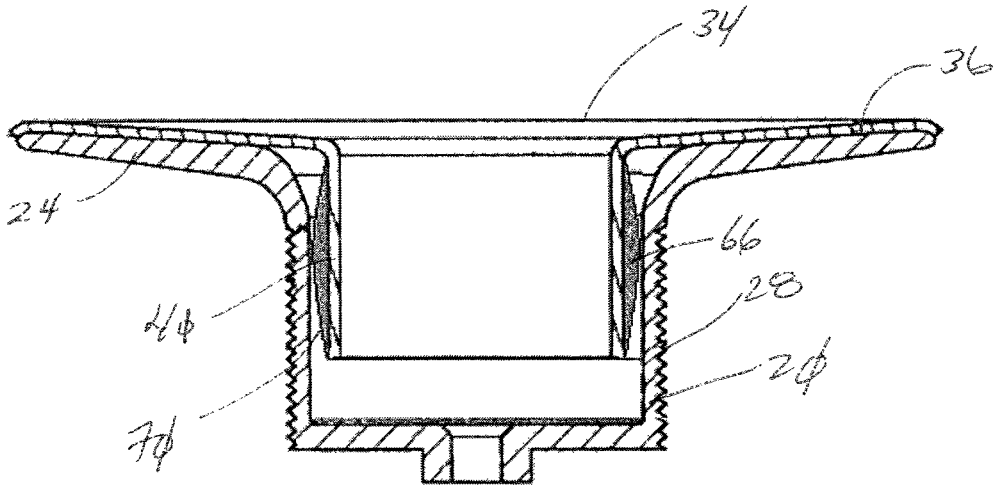
FIG. 5 is a cross sectional view of an assembly of an insert of another embodiment of the present invention that employs an enlarged seal.

FIG. 5 shows another embodiment of the present invention where the insert 34 is used in conjunction with an enlarged seal 66. Here, the seal 66 extends from a lower surface of the flange 36 to a lowermost portion of the insert 34. One skilled in the art, however, will appreciate an enlarged seal 66 of any shape may be employed. The seal 66 blocks the space 43 between the insert 34 and the strainer 20 and centers the insert 34. The seal 66 may have a tapered surface 70 to facilitate insertion into the waste water strainer 20.

Figure 6:
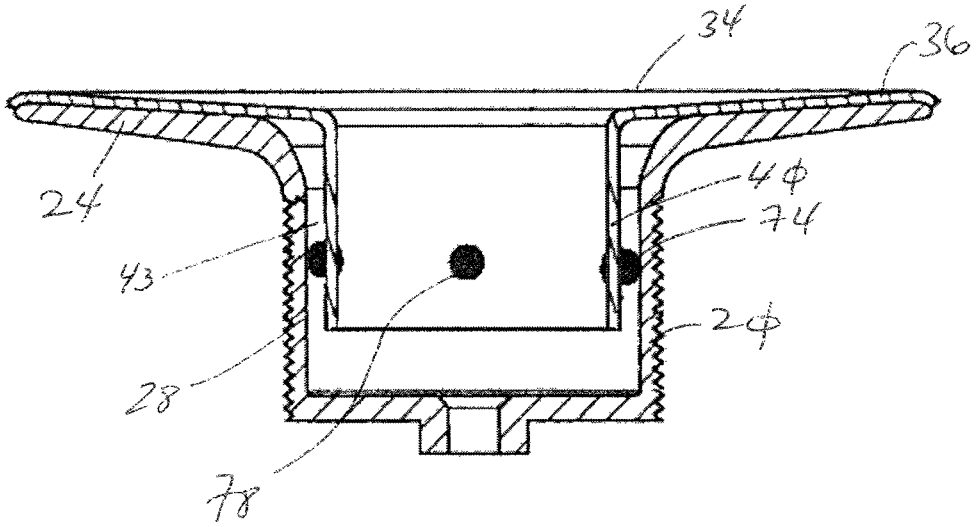
FIG. 6 is a cross sectional view of an insert of another embodiment of the present invention that employs a plurality of buttons.

FIG. 6 shows an insert 34 of the present invention that uses a plurality of resiliently deflectable buttons 74, which are integrated or inserted into holes of the insert 34 to help maintain the insert's 34 position within the strainer 20. For example, an insert 34 having a plurality of holes 78 radially drilled through the wall 40 may be provided. The buttons 74, which are preferably made of an elastomeric material, are inserted within the holes 78 and extend out from the wall 40 such that the effective outer diameter of the wall 40 is increased to correspond with the inner diameter of the strainer 20. Thus, the frictional engagement between the buttons 74 and the strainer 20 help secure the insert 34 within the strainer 20. Although three buttons 74 are shown, one skilled in the art will appreciate that any number of buttons may be integrated into the insert 34.

Figure 7:
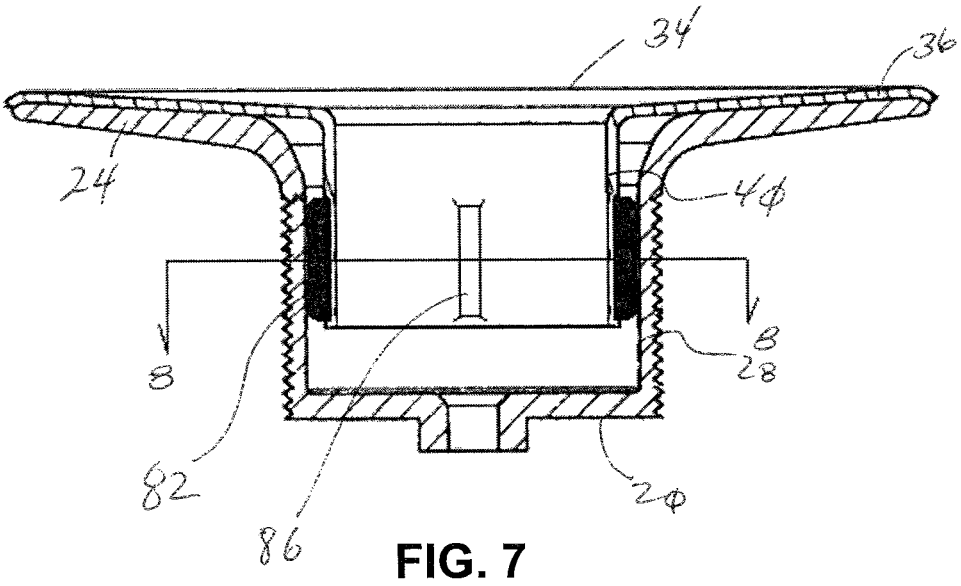
FIG. 7 is a cross sectional view of an insert of an alternate embodiment of the present invention that employs a plurality of seal shims.
Figure 8:
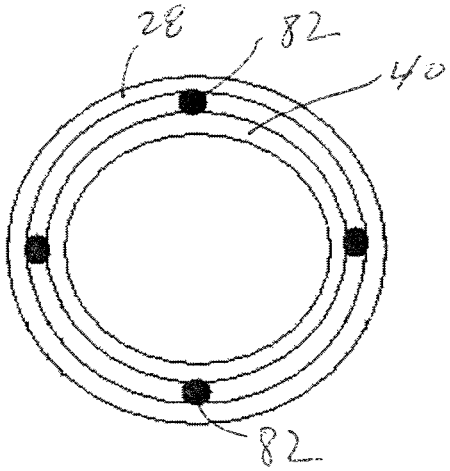
FIG. 8 is a cross sectional view of FIG. 7.

Referring now to FIGS. 7 and 8, another embodiment of the present invention is shown that employs a plurality of elongated shims 82. Here, the strainer 20 includes a wall 40 having a plurality of indentations 86 that receive elongated elastomeric shims 82. The shims 82 are similar to that of the buttons described above and are sandwiched between the strainer wall 28 and the wall 40 of the insert 34 to hold it in place. Here, the insert wall 40 includes a plurality of indentations 86 for receiving the shims 82. One skilled in the art, however, will appreciate that the strainer wall 28 may have openings that extend completely therethrough that receive the shims 82. Further, although three shims 82 are shown, one skilled in the art will appreciate that any number of shims 82 may be employed without departing from the scope of the invention. The shims 82 may extend from the lower portion of the insert to the underside of the flange 36 or only extend a portion of the length of the insert wall 40 as shown.

Figure 9:
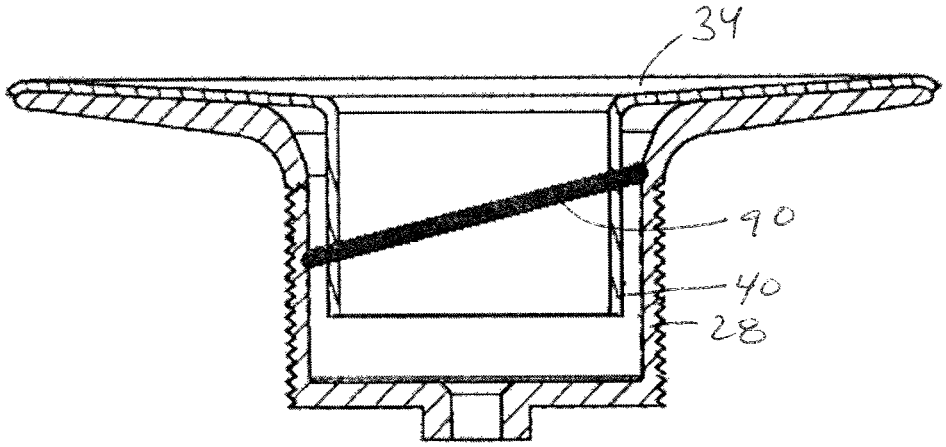
FIG. 9 is a cross sectional view of an insert of another embodiment of the present invention that employs an angled sealing member.

FIG. 9 shows an insert 34 that is associated with a strainer 20 with an angled seal 90. The angled seal 90 may rest in a groove incorporated in the insert wall 40.

Figure 10:
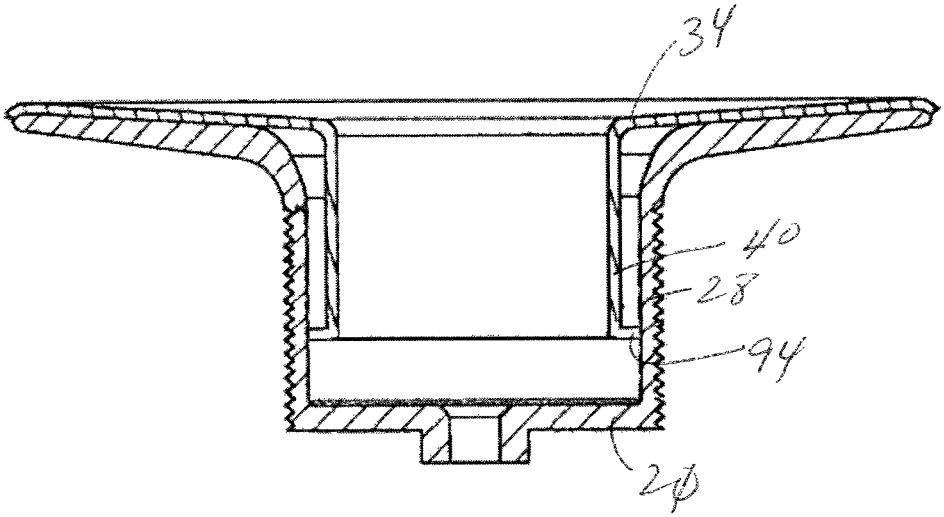
FIG. 10 is a cross sectional view of an insert of another embodiment of the present invention that employs an engaging lip.
Figure 11:
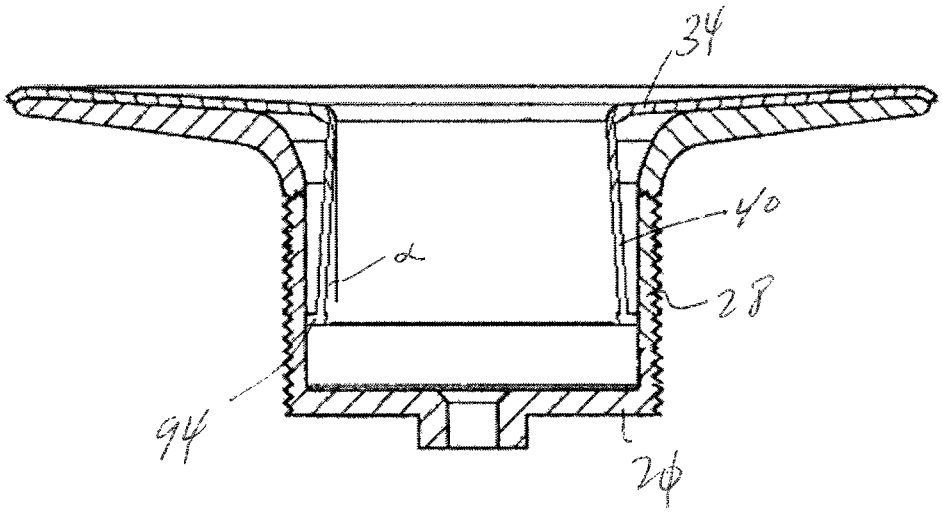
FIG. 11 is a cross sectional view of an insert of another embodiment of the present invention that employs an outwardly extending conical portion.
Figure 12:
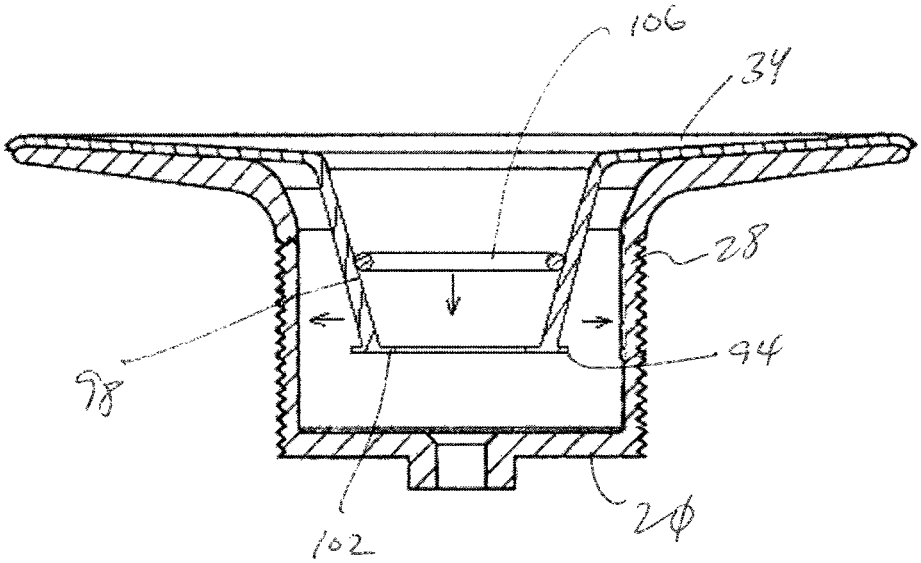
FIG. 12 is a cross sectional view of an insert of another embodiment of the present invention that employs an inwardly extending conical portion.

Referring to FIGS. 10-12, another embodiment of the present invention is shown where the insert 34 includes an engaging lip 94 positioned at the lowermost portion of the wall 40. The lip 94 engages the strainer wall 28 and frictionally aligns the insert 34 to help maintain the position of the insert 34 within the strainer wall 28. In one embodiment of the present invention shown in FIG. 11, the insert wall 40 is angled outwardly (2) and thus must be deflected inwardly for insertion into the strainer wall 28. When the force applied to deflect the wall 40 inwardly is removed the insert wall 40 will deflect outwardly, thereby increasing friction between the lip 94 and the strainer wall 28. To facilitate insertion of the angled wall, a taper (not shown) may be provided on the lip 94 so that when engaged onto the strainer wall 28, the insert wall 40 will be deflected inwardly. Furthermore, those of skill in the art will appreciate that opposed to a continuous insert wall 40, many elongated tabs or walls may be provided.

FIG. 12 is an alternate embodiment wherein a conical wall 98 is provided. The conical wall 98 includes an inner lip 102 that receives a sliding ring 106. In operation, the sliding ring 106 is placed into the strainer wall 28 and moved downwardly, thereby deflecting the sides of the insert wall 40 outwardly to place the lip 94 in engagement with the strainer wall 40. Again, one skilled in the art will appreciate that opposed to a continuous wall, many tabs or subwalls may be provided by this embodiment of the present invention.

Figure 13:
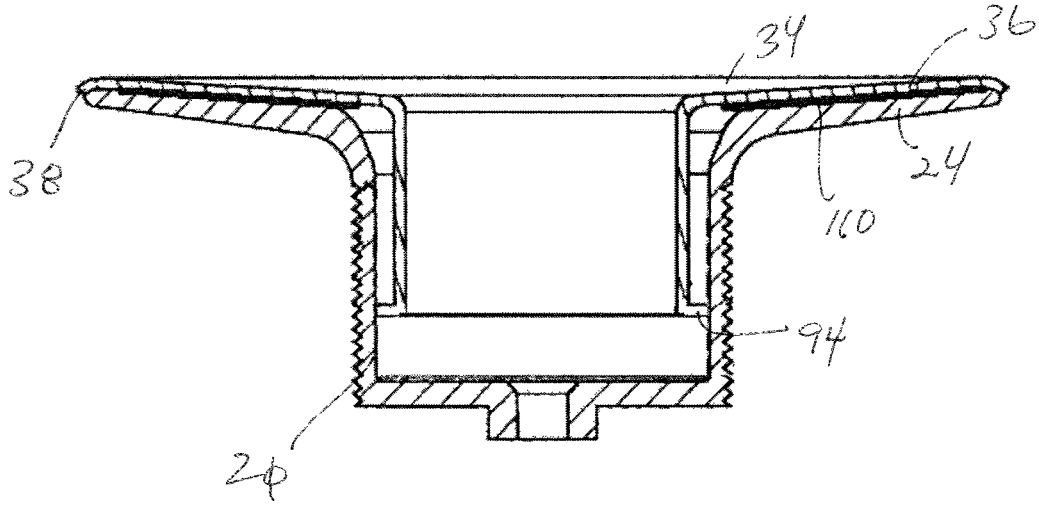
FIG. 13 is a cross sectional view of an insert of another embodiment of the present invention that employs adhesives.

FIG. 13, an alternate embodiment of the present invention is shown wherein an adhesive 110 is used between the insert flange 36 and the strainer body flange 24. An engaging lip 38 may also be included to help center the insert 34 with respect to the strainer body 20.

Figure 14:
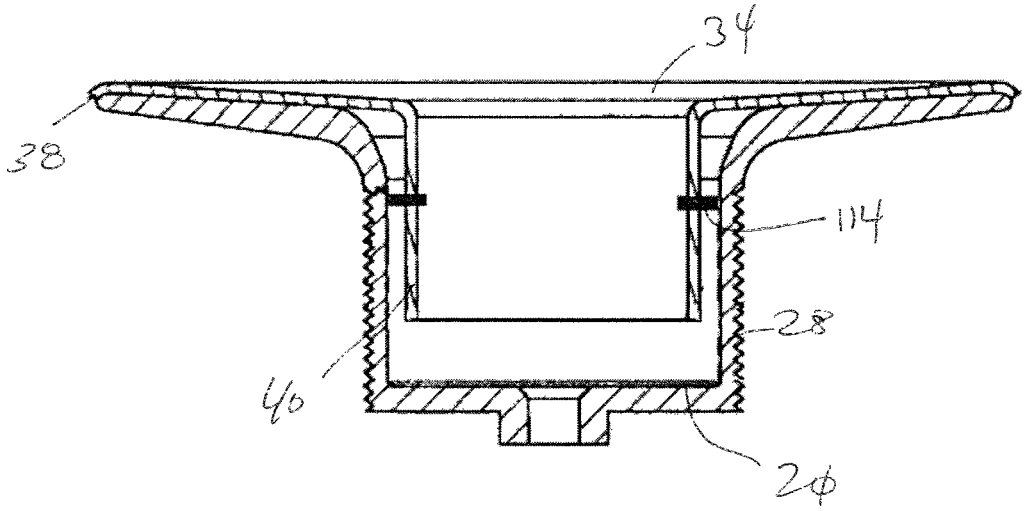
FIG. 14 is a cross sectional view of an insert of another embodiment of the present invention that employs at least one set screw.

FIG. 14 shows yet another embodiment of the present invention where a plurality of set screws 114 are used to secure the insert 34 into the strainer 20. An engaging lip 38 may also be included in this embodiment to help center the insert 34 into the strainer 20. In view of the foregoing, one of skill in the art will appreciate that the methods of inserting and securing the insert into the strainer may be combined. More specifically, embodiments employing the set screw 114 or an engaging lip 38 may also include seals, buttons or other centering and sealing mechanisms described herein.

FIGS. 15-22 show an insert 34 of another embodiment of the present invention that is positioned within the waste water strainer 20 by way of one or more edge engagement members 148. The edge engagement members have an outer portion 122 that selectively engages the waste water strainer 20. The edge engagement member 118 also includes a finger 126 that interfaces with the inner surface 130 of the insert 34. The outer portion 122 and finger 126 are spaced to provide a gap for receipt of the cylindrical sidewall 40 of the insert 34. In one embodiment of the present invention, the edge engagement member 118 is abutted against a bottom edge 134 of the cylindrical sidewall 40. The gap provided between the finger 126 and the outer portion 122 may be slightly smaller than the thickness of the cylindrical sidewall 40 to provide an interference fit between the edge engagement member 118 and the cylindrical sidewall 40.

Figure 15:
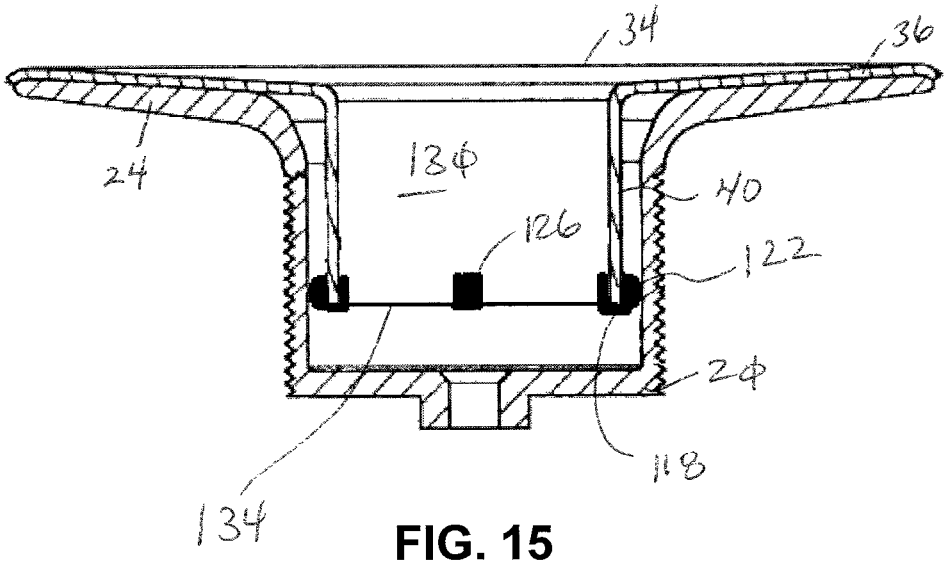
FIG. 15 is a cross sectional view of an insert of another embodiment of the present invention that receives an edge engagement member for selective engagement with a strainer body.
Figure 16:
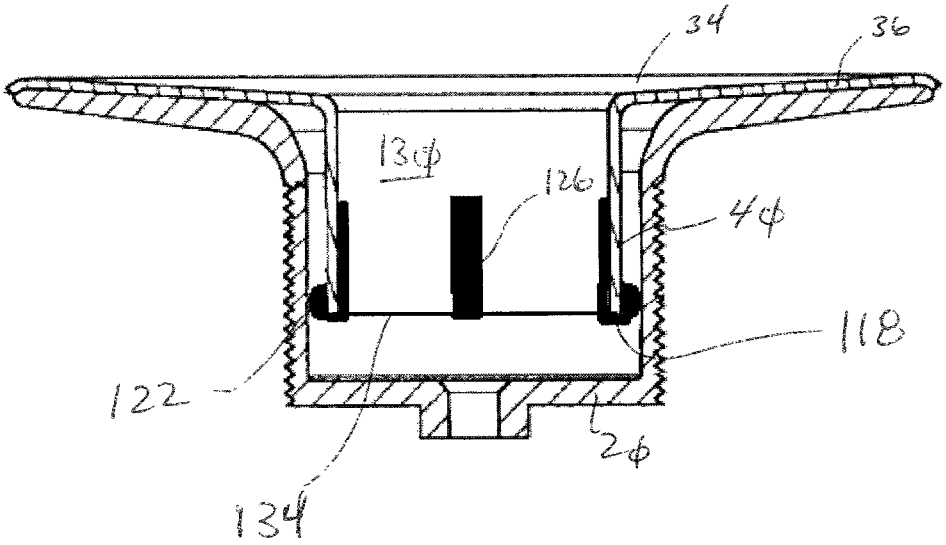
FIG. 16 is a cross sectional view of the insert of FIG. 15 that receives an edge engagement member of an alternate configuration.

Referring specifically to FIGS. 15 and 16, the edge engagement member 118 may have a bulbous outer portion 122 for selective engagement to the strainer body 20. In operation, a plurality of edge engagement members 118 are interconnected to the cylindrical sidewall 40 and firmly secured to the bottom edge 134 thereof. The insert 34 is then forced within the strainer body 20, which deflects the outer portions 122 of the edge engagement members inwardly. After insertion, the resilient nature of the edge engagement members 118 of one embodiment will expand to secure the insert 34. The outer portion may be tapered to facilitate insertion into the strainer body. Further, as shown in FIG. 16, the fingers 126 may be elongated so that more of the inner surface 130 is contacted. Although three edge engagement members 118 are shown, one of skill in the art will appreciate that any number of edge engagement members 118 may be employed without departing from the scope of the invention.

Figure 17:
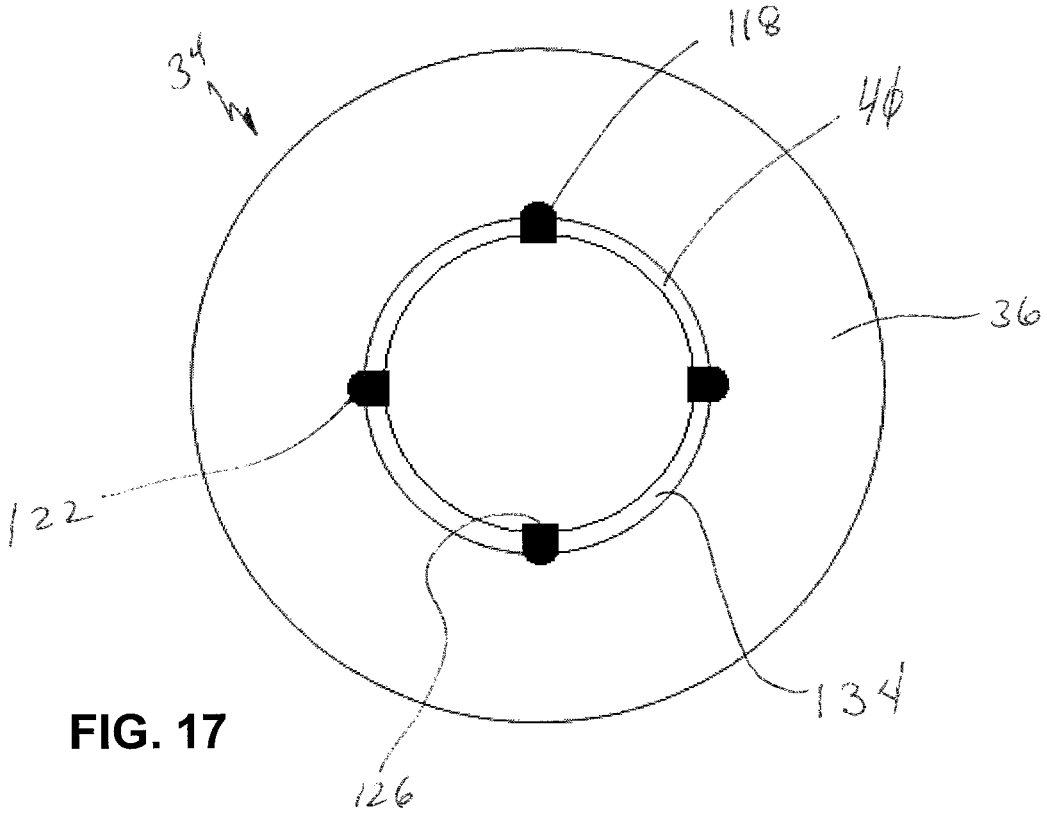
FIG. 17 is a bottom plan view of the insert of FIG. 15 showing the edge engagement members of FIG. 15 or 16.
Figure 18:
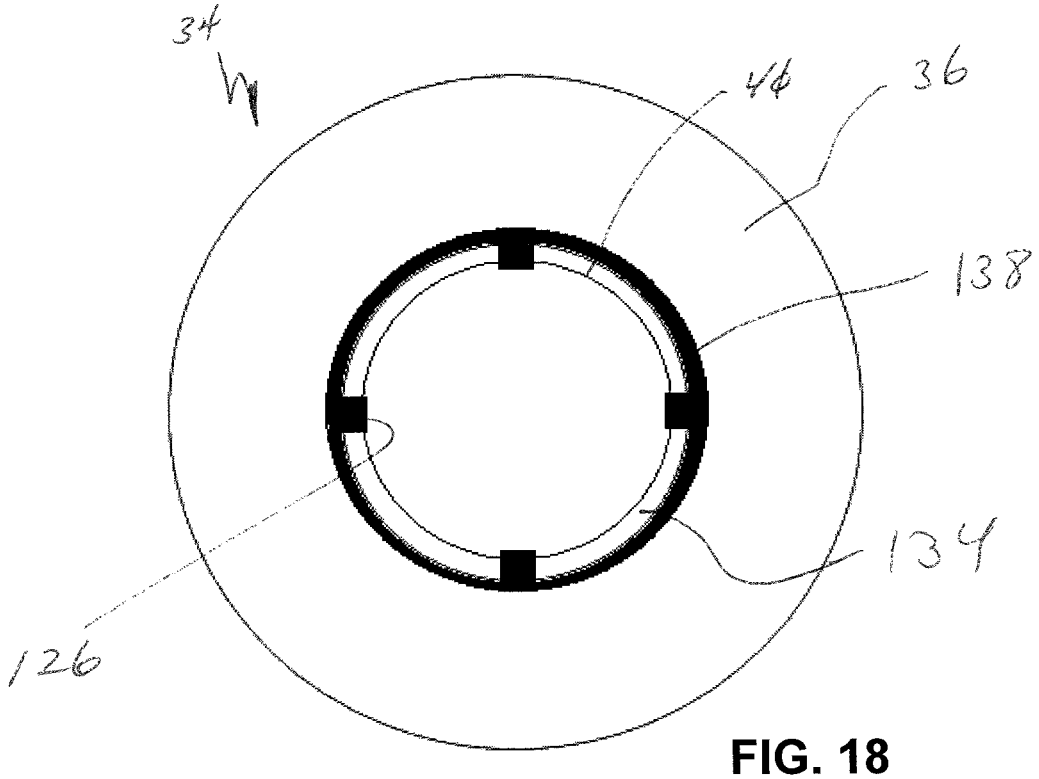
FIG. 18 is a bottom plan view of the insert of FIG. 15 that receives an edge engagement member that has an extended outer portion.

FIG. 17 is a bottom plan view of the insert 34 showing a plurality of edge engagement members 118 associated with the bottom edge 134 of the cylindrical sidewall 40. FIG. 18 shows an alternative configuration where an extended outer portion 138 is provided that increases surface contact with the strainer body. That is, the extended outer portion provides 360° engagement between the insert 34 and the strainer body. One of skill in the art will appreciate that the extended outer portion may be non-continuous to provide less than 360° of contact.

Figure 19:
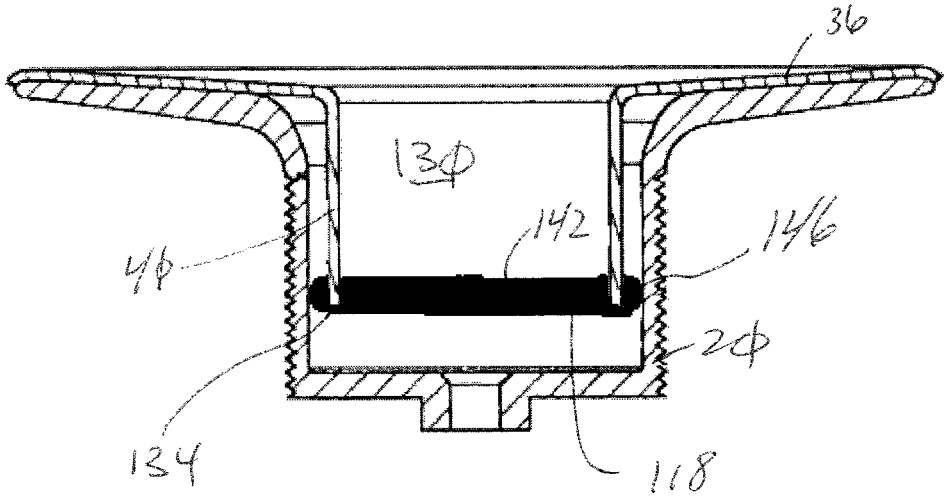
FIG. 19 is a cross sectional view of the insert of one embodiment of FIG. 15 that receives a continuous edge engagement member.
Figure 20:
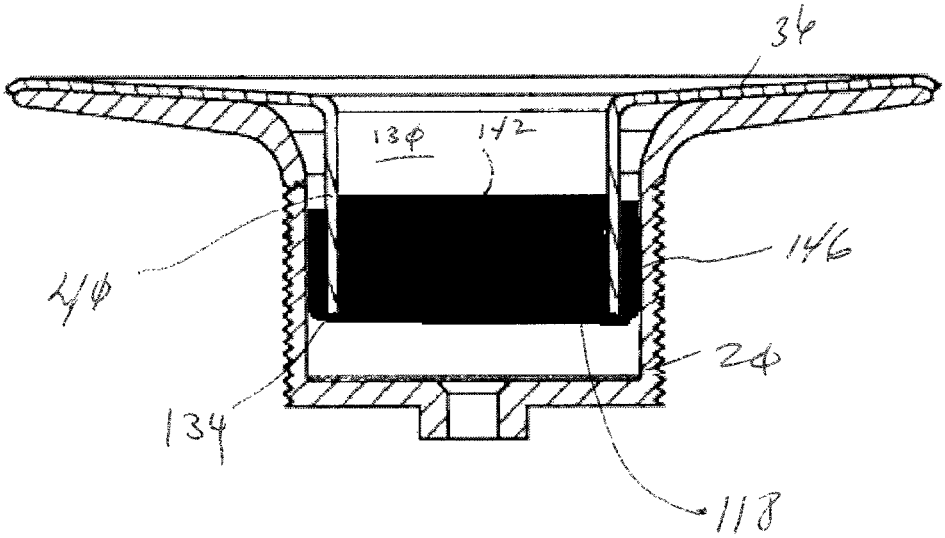
FIG. 20 is a cross sectional view of the insert of FIG. 15 that receives an edge engagement member similar to that shown in FIG. 19 but that has elongated inner and outer portions.

FIGS. 19 and 20 show an edge engagement member 118 of an alternative configuration wherein an inner portion 142 is provided that contacts the inner surface 130 of the insert 34. Similar to the embodiments described above, an outer portion 146 is spaced from the inner portion 142. The outer portion 146 may be bulbous, of a constant cross section, or tapered. As shown in FIG. 20, the outer portion 146 and the inner portion 142 may be elongated to increase the amount of contact area between the cylindrical sidewall 40 and the strainer body 20.

Figure 21:
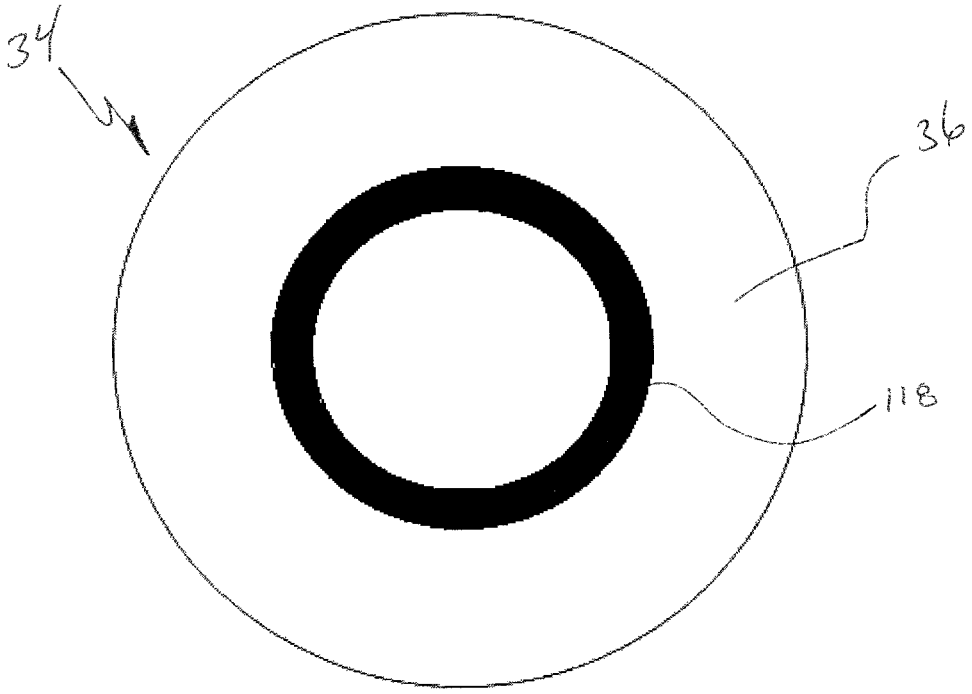
FIG. 21 is a bottom plan view of the insert in combination with the edge engagement member of FIG. 19 or FIG. 20.
Figure 22:
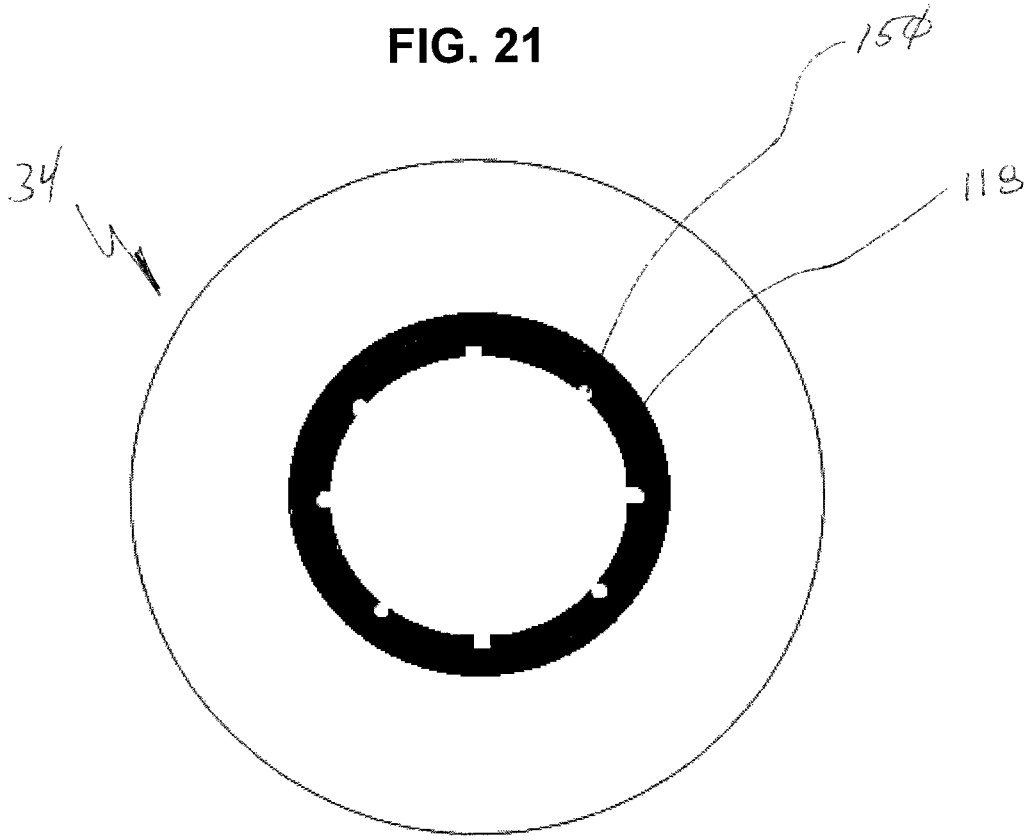
FIG. 22 is a bottom plan view of the insert of FIG. 15 associated with an edge engagement member that has a plurality of grooves.

FIG. 21 is a bottom plan view of an insert 34 associated with the edge engagement member 118 of FIGS. 19 and 20. FIG. 22 is a bottom plan view of an edge engagement member of another embodiment of the present invention where cutouts or grooves 150 are provided that facilitate interconnection with the insert 34. The grooves 150 may be of such a depth as to expose the inner surface 130 of the cylindrical sidewall 40.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. However, it is to be expressly understood that such modifications and alterations are within the scope and spirit of the present invention, as set forth in the following claims.

What is claimed is:

1. A waste water insert adapted to be associated with a strainer that includes a strainer wall having an inner surface, comprising:

a flange;

an insert wall extending from said flange, said insert wall having a continuous cylindrical outer surface that has a first end corresponding with said flange and a second end spaced from said first end, wherein the distance between said first end and second end is constant, said insert wall having an outer diameter that is less than the inner diameter of the strainer wall, such that said insert wall is adapted to be spaced from the strainer wall;

an enlarged seal interconnected to said outer surface of said insert wall, said enlarged seal having a length that corresponds with the distance between said first end and the second end of said insert wall, wherein a first end of said enlarged seal is positioned adjacent to said first end of said insert wall, and a second end of said enlarged seal is positioned adjacent to said second end of said insert wall; and said enlarged seal includes an upper portion spaced from the strainer wall, a lower portion spaced from the strainer wall, and a mid portion that is adapted to contact the strainer wall when the waste water insert is positioned within the strainer, said mid portion having an outer extent that is substantially equal to the diameter of the inner surface of the strainer wall, whereby said waste water insert is positioned within and removed from the strainer without the need of tools.

2. The device of claim 1 wherein said enlarged seal is made of a resilient material.

3. The device of claim 1 wherein said insert wall is devoid of grooves.

4. The device of claim 1, wherein said lower portion of said enlarged seal possesses a tapered surface.

5. The device of claim 1, wherein said flange includes a lip that is adapted to cover a portion of an outer edge of a flange of the strainer that is interconnected to the strainer wall.

6. The device of claim 1, wherein said flange has an outer edge that comprises a downwardly extending lip.

7. A waste water insert adapted to be positioned within a pipe, the pipe having an inner surface, consisting essentially of:

a flange;

a cylindrical wall extending from said flange, said cylindrical wall having an unbroken outer surface that has a first end corresponding with a lower surface of the flange and a second end spaced from said first end, wherein the distance between said first end and second end is constant, said cylindrical wall having a diameter that is less than the diameter of the pipe inner surface, such that said cylindrical wall is adapted to be spaced from the inner surface of the pipe when the waste water insert is positioned in the pipe;

a resilient seal interconnected to said cylindrical wall, said resilient seal having a proximal end and a distal end that coincide with said first end and said second end of said cylindrical wall, said resilient seal also having a tapered surface at said distal end, said resilient seal having a portion located above said tapered surface that is adapted to contact the inner surface of the pipe, said portion having an outer extent that is substantially equal to the diameter of the inner surface of the strainer wall; and wherein said flange of said waste water insert is adapted to be positioned adjacent to an upper end of the pipe, wherein said cylindrical wall extends downwardly into an opening defined by the pipe, and said resilient seal is adapted to be positioned within a space provided between an outer surface of said cylindrical wall and the inner surface of the pipe, whereby said waste water insert is positioned within and removed from the pipe without the need of tools, such that when said waste water insert is positioned within the pipe, said proximal end and said distal end of said resilient seal do not contact the inner surface of the pipe.

8. The waste water insert of claim 7, wherein said resilient seal has a cylindrical inner surface that resiliently grips said insert wall.

9. The device of claim 1 wherein said enlarged seal is in close contact with said insert wall.

10. The device of claim 1 wherein said enlarged seal forms an elastomeric layer of said insert wall.

* * * * *